United States Patent [19]

Gazda et al.

[11] 4,069,865

[45] Jan. 24, 1978

[54] BOTTOM HOLE FLUID PRESSURE COMMUNICATING PROBE AND LOCKING MANDREL

[75] Inventors: Imre I. Gazda, Saginaw; Albert W. Carroll, Dallas, both of Tex.

[73] Assignee: Otis Engineering Corporation, Dallas, Tex.

[21] Appl. No.: 764,082

[22] Filed: Jan. 31, 1977

Related U.S. Application Data

[63] Continuation-in-part of Ser. No. 612,780, Sept. 12, 1975, abandoned.

[51] Int. Cl.[2] ..... E21B 33/12; E21B 49/00

[52] U.S. Cl. ..... 166/113; 166/152; 166/163; 166/264

[58] Field of Search ..... 166/113, 162, 163, 69, 166/152, 264

[56] References Cited

U.S. PATENT DOCUMENTS

| | | | |
|---|---|---|---|
| 3,096,823 | 7/1963 | Crowe | 166/152 |
| 3,190,360 | 7/1965 | Farley | 166/152 |
| 3,850,240 | 11/1974 | Conover | 166/264 |

*Primary Examiner*—James A. Leppink
*Attorney, Agent, or Firm*—Warren H. Kintzinger

[57] ABSTRACT

A well bottom hole fluid pressure measuring structure including external to internal pressure transducer fluid passage communicating structure with pressure balancing on engaged probe members to prevent undesired pressure lift separation of one probe section from another. A locking mandrel, landing nipple and probe structure is provided with positioning of the probe to the lock set state holding the mandrel in a locked state such that fluid pressure differential across the mandrel cannot unlock the probe from the mandrel.

60 Claims, 14 Drawing Figures

BOTTOM HOLE FLUID PRESSURE COMMUNICATING PROBE AND LOCKING MANDREL

This application is a continuation-in-part of our copending application, Ser. No. 612,780, filed Sept. 12, 1975, now abandoned.

This invention relates in general to well pressure measuring tools, and in particular to improved well bottom hold fluid pressure measuring probes, with pressure balancing about fluid passage interconnects between cooperating parts in a fluid passage system to a pressure measuring chamber.

In the recovery of oil and/or gas from wells drilled to producing formations, it is at various times desirable to get a recording of bottom hole, or down-the-hole, fluid pressures. Different approaches in obtaining such desired pressure information have encountered sundry problems, not the least of which includes high pressure at the bottom of a well and high pressure differential across pressure measuring devices that are lowered into a well. Structures positioned in a well, blocking fluid flow for obtaining static pressure readings, must at times be capable of withstanding tremendous fluid pressures, and therefore impose a requirement for positive locked-position retention within a well casing, and positive bottom-to-top fluid seal across such a bottom hole pressure (BHP) measuring and recording structure. Many previously employed devices are not capable of withstanding high pressure and, also, many are subject to undesired device-lifting, by bottom-to-top pressure differentials thereacross.

It is therefore a principal object of this invention to provide down-the-well pressure measuring structures with mandrels landed in casing landing nipples.

Another object with such a well pressure measuring structure is a probe structure with fluid pressure balanced on probe-to-projection interconnect, and, thereby, no probe differential pressure lift-off.

A further object is positive mandrel-to-nipple dog locking against mandrel differential pressure lifting, with a probe in place within a mandrel.

Features of this invention useful in accomplishing the above objects include, in a bottom hole fluid pressure communicating probe and locking mandrel, a well casing nipple landing mandrel structure capable of receiving a bottom hold fluid pressure probe structure, with the mandrel holding a projection device telescoping with the probe structure as the probe structure is lowered into fluid pressure measuring position. Balanced sealing is provided in telescoping parts so that fluid passage interconnect therebetween does not lead to high pressure differential lift-off of probe structure. Further, with packer seal structure between a mandrel and casing wall, fluid flow bypass is provided to facilitate probe structure lowering and/or mandrel structure run down lowering to its landing nipple in a well.

Specific embodiments representing what are presently regarded as the best modes for carrying out the invention are illustrated in the accompanying drawings.

Figure 7:
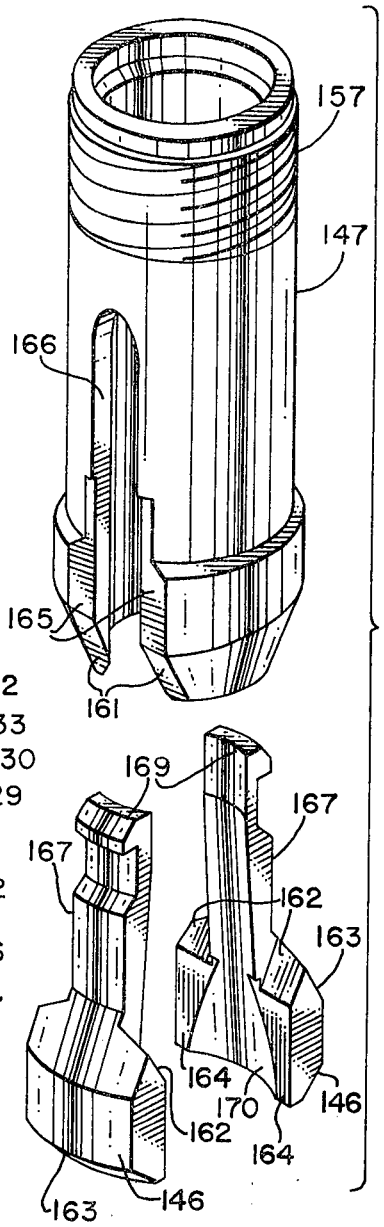
Figure 3:
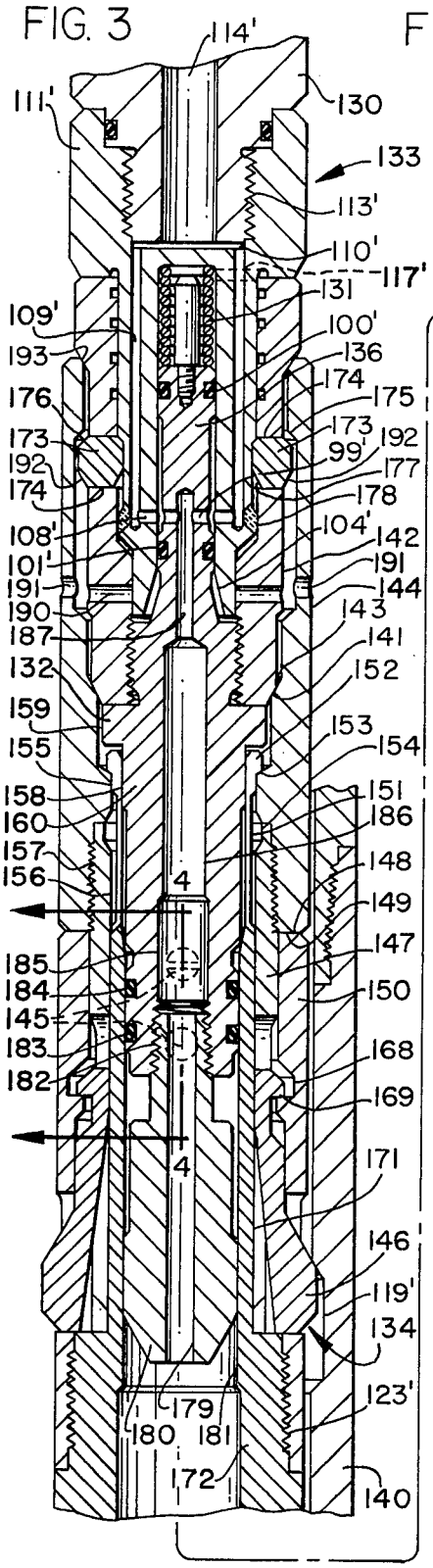
FIG. 3, is a side elevation, cut-away and sectioned view of still another BHP probe and mandrel embodiment.
Figure 4:
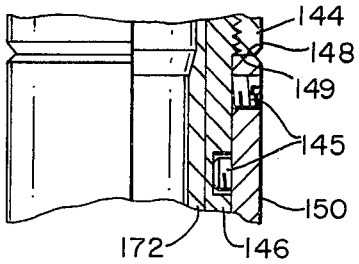
Figure 4:
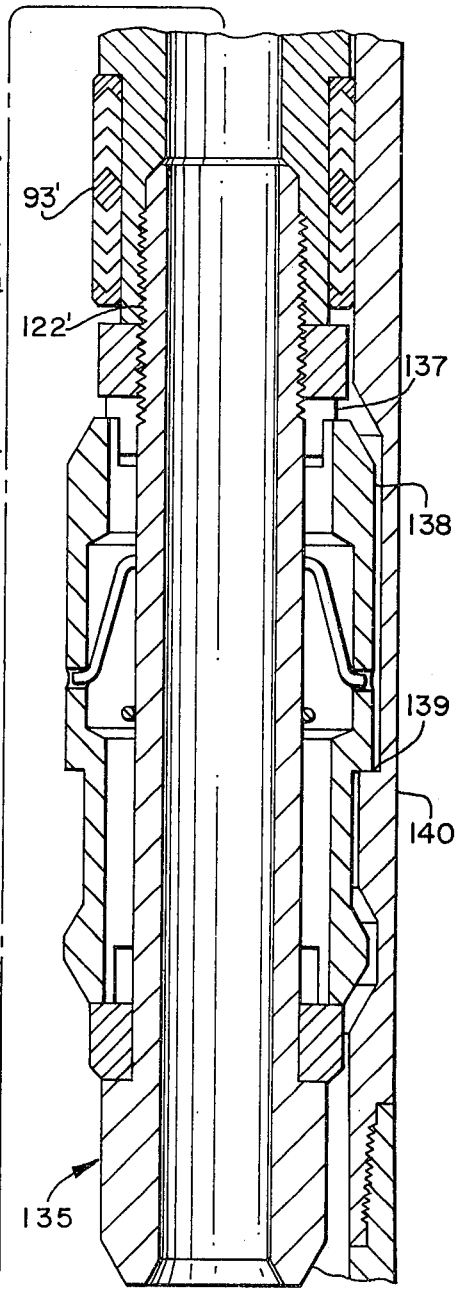
Figure 5:
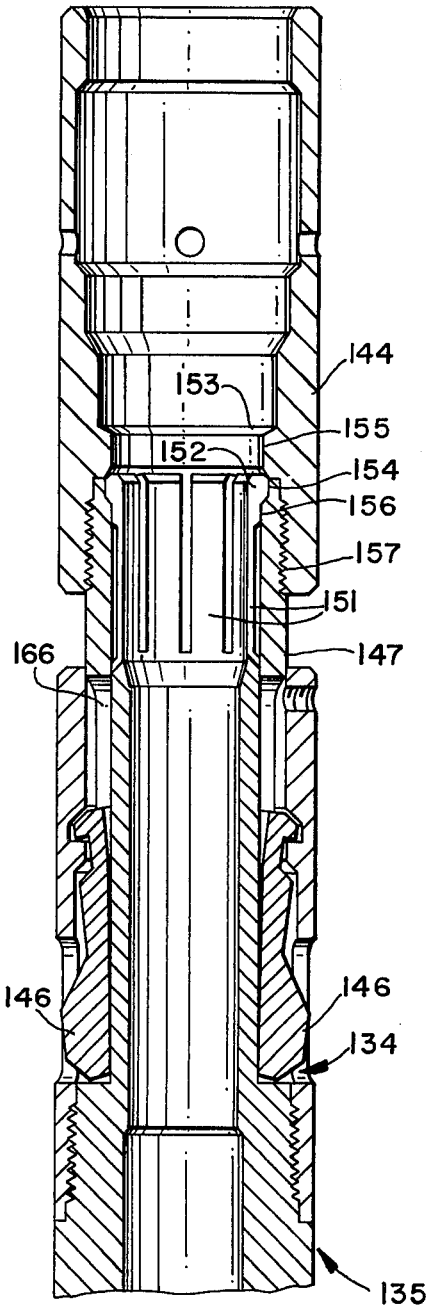
Figure 6:
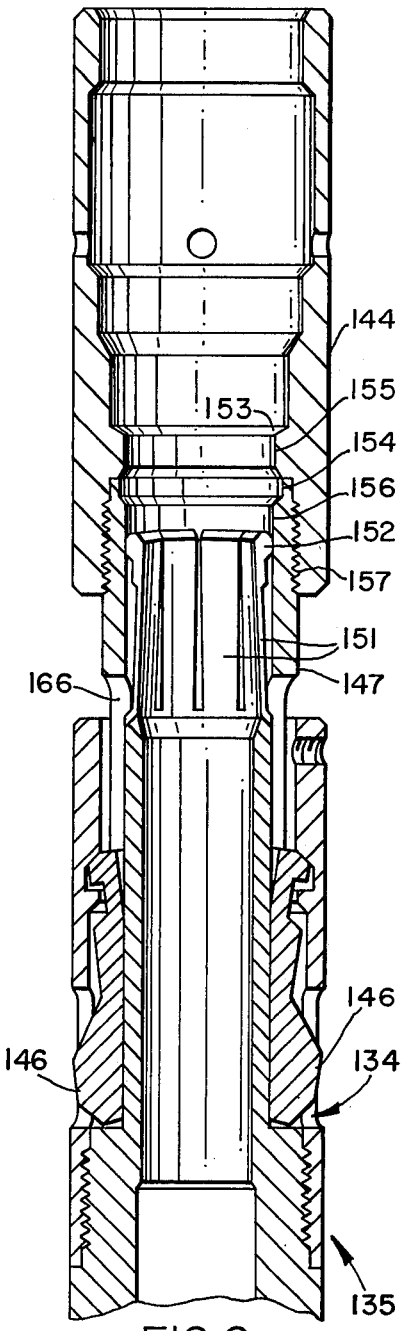
Figure 8:
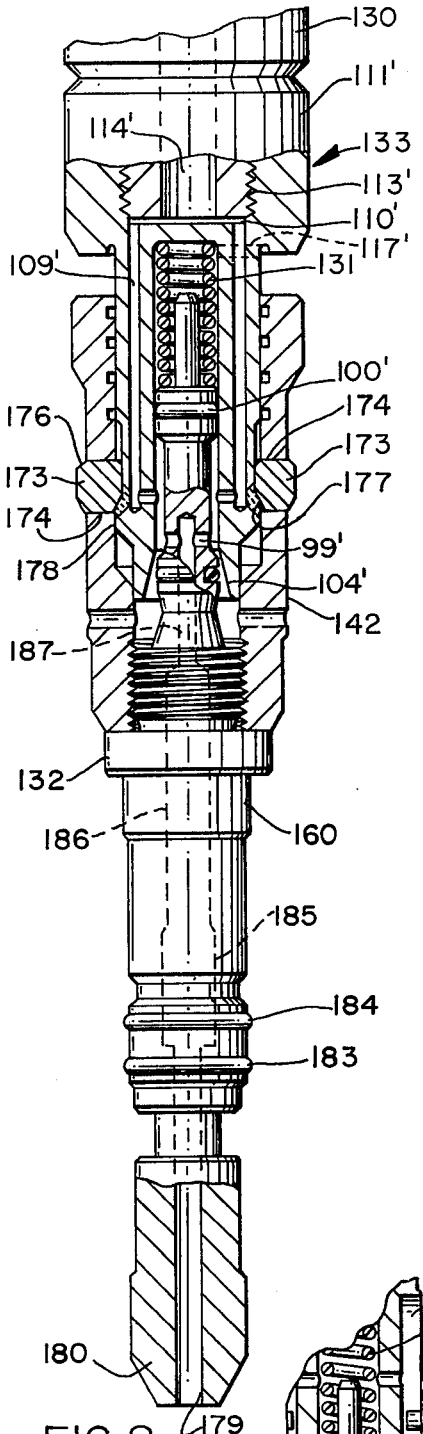
Figure 9:
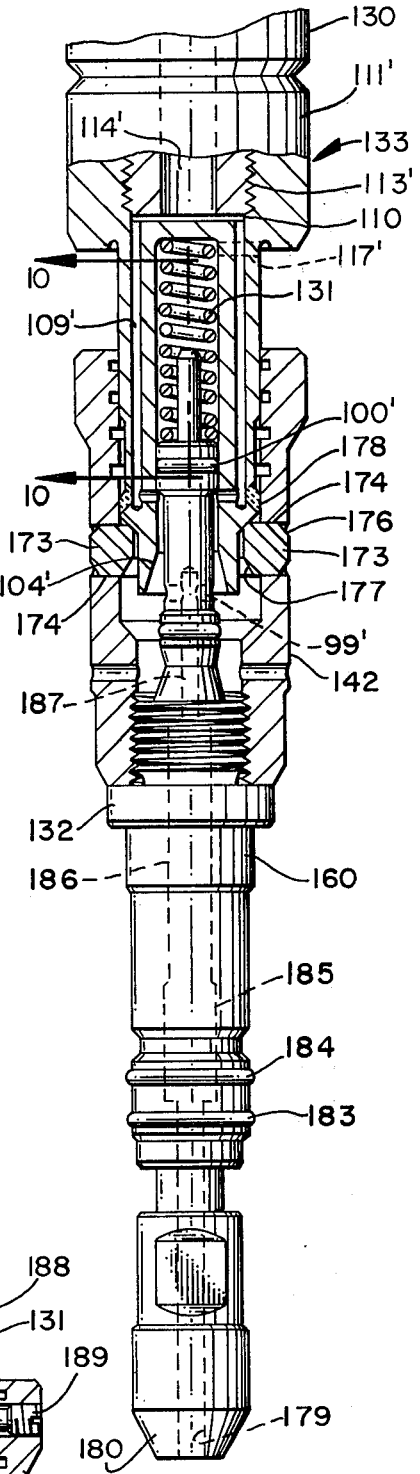
Figure 10:
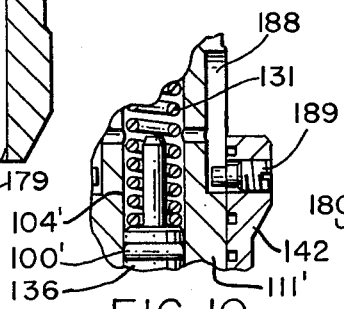
Figure 11:
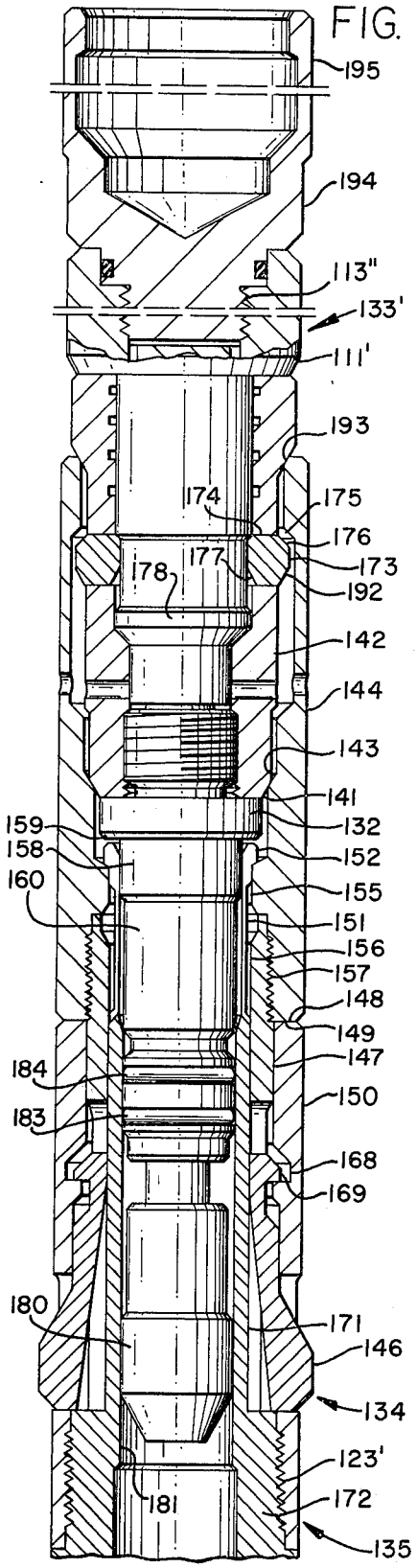
Figure 12:
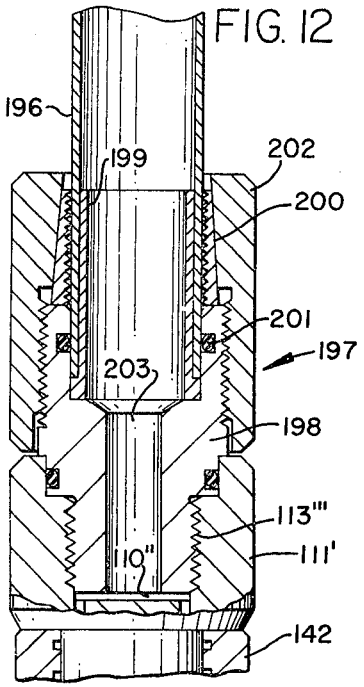
Figure 13:
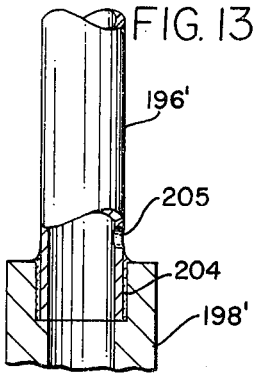
Figure 14:
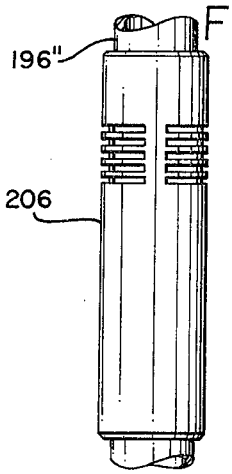

FIG. 4, a partial, broken-away and sectioned shear screw detail view taken from line 4—4 of FIG. 3;

FIG. 5, a partially broken-away and sectioned side elevation view of the mandrel assembly and fishing neck of the FIG. 3 embodiment in the run state;

FIG. 6, a partially broken-away and sectioned side elevation view of the mandrel assembly and fishing neck of FIGS. 3 and 8, in the pull state;

FIG. 7, an exploded perspective view of locking dogs and the dog cam expander sleeve used in the FIG. 3 embodiment;

FIG. 8, a partially broken-away and sectioned side elevation view of the probe assembly of FIG. 3, in the equalized state;

FIG. 9, a partially broken-away and sectioned side elevation view of the probe assembly of FIG. 3, in the run state;

FIG. 10, a partial, broken-away and sectional longitudinal relative movement limit pin and slot structure detail view taken from line 10-10 of FIG. 9;

FIG. 11, a side elevation, partially cut away and sectioned view of a probe with a stop plug having an upper fishing neck in place of a weight bar extension in the FIG. 3 embodiment;

FIG. 12, a partial side elevation, cut away and sectioned view of a probe structure with a tube end fitting for a tube extending from the well head used with a well probe;

FIG. 13, a partial side elevation, partially broken away and sectioned view of a tube, with a hole, having the tube and end soldered or brazzed in place in a tube and fitting for a well probe; and FIG. 14, a tube equipped with a concentric gas lift valve such as the tube of FIG. 12 or FIG. 13.

Figure 1:
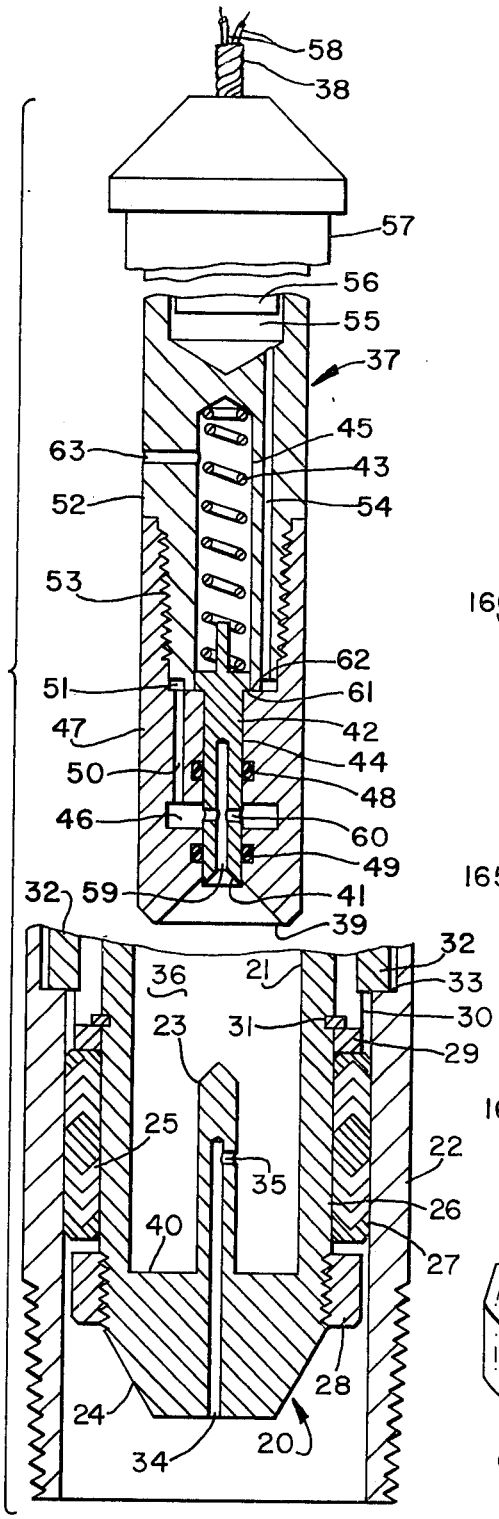
FIG. 1 represents a side elevation, cut-away and sectioned view (with portions removed as a matter of convenience) of a bottom hole pressure measuring structure including a wire line suspended probe structure cooperatively received by a casing nipple landed mandrel with a bottom housing nose end containing an upward projection with an internal fluid passage.

Referring to the drawings: The bull plug type device 20 of FIG. 1 that is locked in place with a suitable locking mandrel 21 (only partially shown) in a well casing landing nipple 22, is equipped with an upwardly-extended, centrally located projection 23. The projection 23 extends up within the bottom cage housing nose end 24 of the mandrel structure. A packer seal 25 provides a seal between the outside 26 of the bottom cage housing nose end 24 and the interior wall 27 of a well casing landing nipple 22. The packer seal 25 is retained in place between retainer ring 28 and the bottom end portion 29 of key housing 30 that is locked in place from upward movement, relative to locking mandrel 21, by snap ring 31. The key housing 30 and locking mandrel 21 are locked from further movement down the well casing by the landed seating of the keys 32 on landing shoulder 33 in casing nipple 22. With this structure, and complete sealing of packer seal 25, the only fluid communication path from below the packer seal to above the seal within the casing is through opening 34 and orifice 35. This is with opening 34 extending from the bottom of cage housing nose end 24, upward, through much of the length of projection 23, and through a side orifice 35 connecting the opening 34 to the interior 36 of the bottom cage housing nose end 24.

Bottom hole pressure (BHP) measuring probe assembly 37 is constructed to move down into the interior of locking mandrel 21, with the bottom end thereof sliding down within the opening 36, as lowered by wire or cable 38 within the bottom cage housing nose end 24 until the bottom 39 thereof comes to rest on the bottom floor 40 of opening 36. Through the final range of probe 37 downward movement, the probe telescopes down over projection 23, with the projection 23 contacting the lower end 41 of plunger 42 and moving it upwardly against the resilient force of spring 43, slidably within plunger opening 44 and into spring retaining chamber 45, immediately above and contiguous with plunger opening 44. When probe 37 is fully telescoped down over projection 23, the orifice forming part 35 is in direct fluid communication with internal recess 46, located in probe member 47 between upper and lower o-ring and groove structures 48 and 49 that establish fluid sealing contact with plunger 42 (in the down position), and with projection 23 when in the fully telescoped state. Fluid communication extends upwardly through passageway 50 to an annular recess 51 formed at the bottom of BHP probe member 52, between probe member 52 and 47 when the member 52 is seated in probe member 47, with threads 53 tightened. Vertical passageway 54 interconnects annular recess 51 and chamber 55, containing (BHP device) bottom hole pressure sensing device 56, whereby bottom hole pressure at the bottom of opening 34 may be sensed as communicated through the passages interconnecting the bottom of the housing nose 24 with chamber 55, when the probe unit 37 is fully telescoped in place on projection 23. Pressure sensing device 56, that is mounted on probe cap member 57 to project into chamber 55 when the rope socket 57 is assembled in place at the top of probe assembly 37 (rope socket 57 may be attached as by threads on the top of probe member 52 — detail not shown), may be a self-contained pressure recorder, read when the probe 37 is removed from the well, or it may be a pressure transducer, transmitting pressure readings continuously through connective wiring 58, to the surface, for constant, in-place readout.

With this structure, pressures are balanced with an O-ring 48 above and an O-ring 49 below the part 35 when the probe 37 is telescoped in place and seated on housing floor 40, and there is no tendency for fluid pressure-lifting of the probe structure 37, up, from the telescoped state on projection 23. Thus, little weight is needed to lower the probe 37 to the telescoped state on projection 23 and to maintain the probe 37 telescoped state. It should also be noted that plunger 42 not only serves to protect O-rings 48 and 49 when the probe 37 is free of the telescoped state with probe 23, but has a longitudinal passage 59 from the bottom, connected through lateral ports 60 to recess 46 when plunger shoulder 61 is seated on internal surface 62 of probe member 47. This passage and plunger 42 structure is a provision such that when probe 37 is lifted off projection 23, fluid pressure is not trapped in BHP chamber 55, but bleeds off through the passages in plunger 42. Further, through-wall passage 63, from spring-containing chamber 45, to the exterior of probe member 52, prevents fluid hydraulic pressure build-up as plunger 42 is raised compressing spring 43 during telescoping of the probe 37 down on projection 23. Please note that the O-rings could be provided in O-ring grooves on projection 23 above and below port 35, in place of the O-ring structures 48 and 49 in the probe member 47, with the same balancing of hydraulic fluid pressures when the probe 37 is telescoped in place on probe 23. This projection mounting of O-rings is, in fact, a feature of the following described embodiment. Flow of the well with locking mandrel 21 landed in place is limited to flow through passage 34 and out through orifice 35 when the probe 37 is off projection 23.

Figure 2:
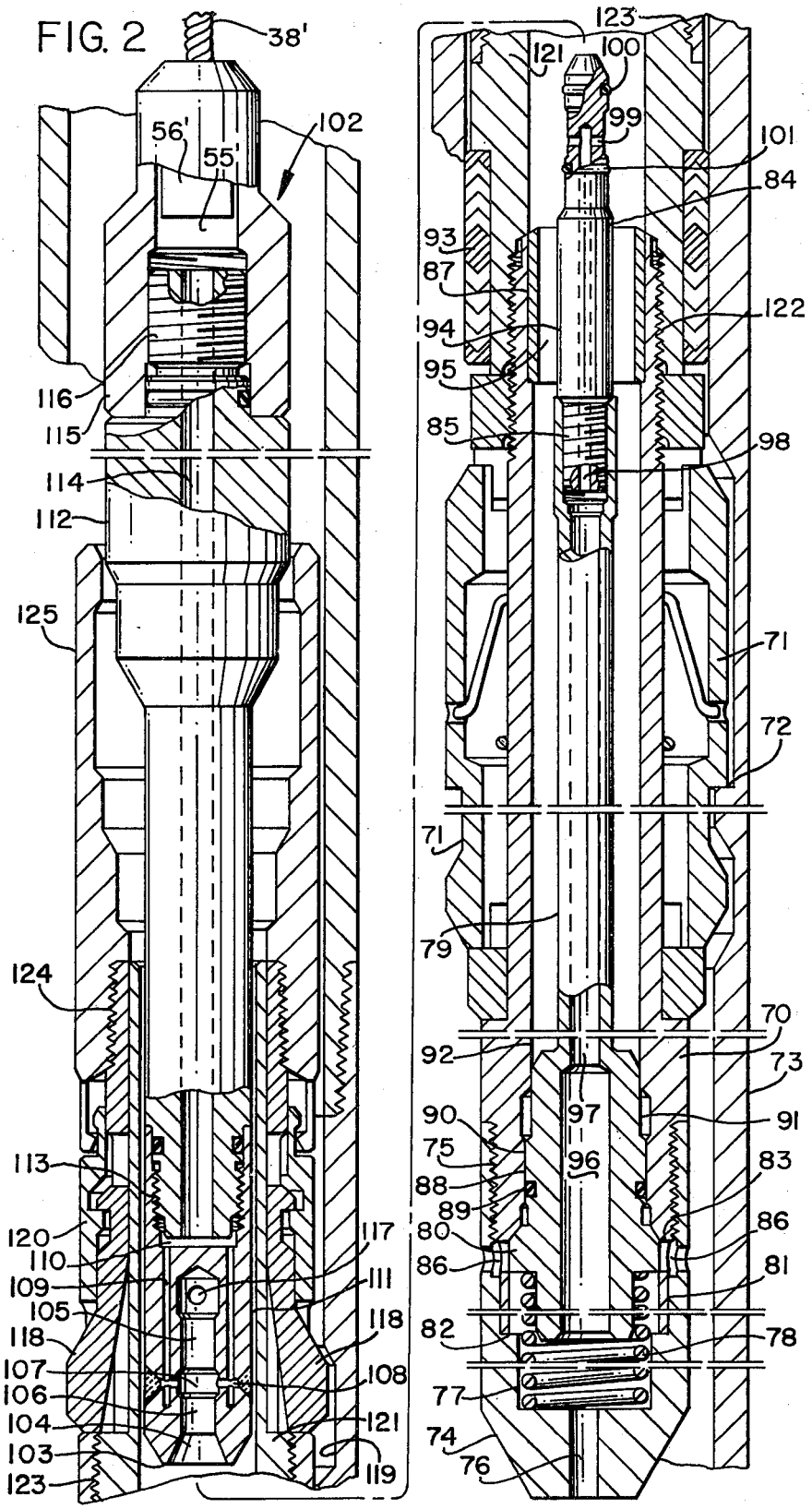
FIG. 2, is a side elevation, cut-away and sectioned view of another down-the-hole well pressure measuring probe and mandrel structure embodiment.

Referring now to the bottom hole pressure measuring system of FIG. 2, locking mandrel 70 is shown in place within a well, with "S" type keys 71 landed on shoulder 72 of well casing landing nipple 73. The mandrel 70 is equipped with a bottom housing nose end 74 mounted by threads 75 on the bottom end of mandrel 70, and the housing has a bottom opening 76 in fluid communication with an internal chamber 77 containing coil spring 78. An elongate valve member 79, slidably mounted within mandrel 70, has an enlarged bottom shoulder 80 slidable up and down in a sleeve 81 mounted within chamber 77 of housing nose end 74, and confined between chamber shoulder 82 and the bottom end 83 of mandrel 70. Coil spring 78 resiliently raises the valve member 79 toward the upper position thereof shown. However, when the projection member 84, connected by threads 85 to the top of valve member 79 is pressed down causing the valve member 79 to compress spring 78, valve structure around the lower portion of valve member 79, and above shoulder 80, opens and bypass flow is permitted in through openings 86 through the wall of bottom end nose housing 74 and the sleeves 81, up and around the valving surfaces of valve member 79, to an annulus space within the interior mandrel 70, around valve member 79, and on through the longitudinally channeled spider member 87. This is with the valve member 79 lowered sufficiently against the resilient upward force of spring 78 that the outer periphery of shoulder 80 moves down sufficiently to uncover the openings 86, and that the cylindrical portion 88, with O-ring structure 89, is unseated by being slid below the internal cylindrical section 90 of the mandrel. This also includes downward displacement of the annular surface portion 91 of the valve member from the cylindrical section 92 of the mandrel 70. While this may be accomplished by depression of the valve member by downward force being exerted on the projection 84 after the mandrel is locked in place in a landing nipple near the bottom of a well, it may also be accomplished by a running tool to facilitate installation of the device in a well with through bypass flow permitted within the well as the device is being lowered, since the packing seal 93 would prevent fluid bypass flow around the outside of the mandrel structure; that is, between the mandrel structure and the internal wall of well casing. Without this internal valve fluid bypass feature, installation of the locking mandrel, with lowering of the locking mandrel to its landing nipple, would for example entail pushing fluid back into the formation — a difficult job to accomplish with a string of wire tools. It should be noted that the shank cylindrical surface 94 of projection member 84 is slidable within and through the longitudinal space defined by the inner ends of the interior channel wall projections 95 of spider 87. Within the valve member 79 slidably contained within the mandrel 70, fluid communication for bottom hole pressure measuring is provided through first opening 96, at the bottom; then, opening 97; and then, entering the projection member 84 itself — passage is through longitudinal opening 98 to side orifice parts 99, positioned between upper O-ring structure 100 and lower O-ring structure 101.

The bottom hole pressure (BHP) measuring probe assembly 102, suspended by wire 38' and equipped with a pressure measuring device 56' positioned within chamber 55', is equipped (at the bottom probe end thereof) with an end surface 103 that comes into seating engagement with the top of spider 87 when the probe opening 104 is fully telescoped down over the top of projection member 84. O-ring structures 100 and 101 are sliding-seal fits within the sections 105 and 106, respectively, of the probe opening 104, and provide for fluid pressure balancing when the parts 99 of the projection 84 are positioned in alignment with enlarged annular opening 107. Side port extensions 108, from opening 107, extend to vertically-extended passages 109, extending upwardly to chamber 110 formed between probe lower member 111 and the probe upper member 112 that are connected together by threading 113. A vertically-extended longitudinal passage 14 extends from chamber 110 through the vertical length of probe member 112, to the upper pressure chamber 55' and cap member 115, that is assembled to the top of probe member 112 by a threaded connection 116.

As the opening 104 of probe 102 is telescoped down on the upper end of projection member 84, wall opening 117-from the top of opening 104 to the outside of probe lower member 111-provides for fluid flow to and from the top of opening 104 during telescoping movement of the probe 102 on projection member 84. Further, the dog structure, with dogs 118, engage annular recess 119 within the casing nipple 73, to lock the mandrel assembly including the dog housing 120 mounted over mandrel extension 121 that is connected to the top of mandrel member 70 by threads 122. Dog housing 120 is connected with threads 123 to a mandrel extension 121 and in turn has a connection at the top through threads 124 to fishing neck 125 that is used with fishing and running tools (not shown) for locking and unlocking of dogs 118 with installation and removal of the locking mandrel 170.

With reference to the more completely detailed, preferred embodiment of FIGS. 3 through 10, the weight bar extension 130, cut off as a matter of convenience, has a center longitudinal opening 114' extending up to an upper pressure chamber 55', such as shown with the embodiment of FIG. 2. Wile there are many similarities between this embodiment and that of FIG. 2, there are also significant differences and additions. A spring 131 is added to the projection structure 132 and contained in an extended probe opening 104' to improve running of the device. With this embodiment, however, the projection structure 132, that in other embodiments is part of the locking mandrel structure, is there an accessory part of the probe structure 133. Further, with the overall probe system of this embodiment, a dog locking structure 134 is provided for locking the mandrel assembly 135 in such a way that pressure differential through from the bottom of the landed mandrel and probe assembly to the top thereof cannot unlock the probe from the mandrel assembly.

FIG. 3 shows the probe structure 133 with the projection structure 132 upper projection 136 fully telescoped in probe opening 104', in the operation state locked within the mandrel assembly 135, and with the mandrel key housing 137 with "S" keys 138 landed in place on shoulder 139 of casing landing nipple 140. In this embodiment, the mandrel assembly 135—other than for the dog locking structure 134 portion and an upper collet section—generally is of known nipple landing mandrel key and casing landing nipple construction. The probe member 111° with opening 104' is lowered as part of a wireline tool system, to the operation state shown in FIG. 3, with enlarged tapered section 141 of lug housing 142 seated on tapered shoulder 143 of the fising neck exterior 144 of the mandrel assembly 135. Lug housing 142 is a part of the projection structure 132 that is interconnected for limited relative movement. A heavy running tool may be used to shear the shear screws 145 to the sheared state shown in FIG. 4, with the dog 146 cam expander sleeve 147 and fishing neck extension 144 slid down from the run state of FIG. 5 to the operational state of FIG. 3. This brings the bottom 148 of the fishing neck extension 144 into abutting contact with the top 149 of dog retainer housing 150 and simultaneoulsy moves the dog expander sleeve 147 down in a dog 146 outward camming action that moves dogs 146 outward into locked state engagement in annular recess 119' of the casing landing nipple 140. Another state of the mandrel assembly 135 and fishing neck extension 144 with dog expander sleeve 147 is the pull state of FIG. 6, with collet fingers 151 drawn down and radially deflected inwardly by collet finger projections 152 being cammed inwardly from the set state of FIG. 3. This is accomplished with relative longitudinal movement, the collet finger projections camming in over slanted fishing neck shoulder 153 and from annular recess 154, formed at the internal junction of the expander sleeve 147 and the fishing neck extension 144, with cam sloped top and bottom shoulders for camming the sloped top and bottom surfaces of the finger projections 152, and being held in the deflected inward state when riding on bore surfaces 155 and 156. Bore surfaces 155 and 156 are within adjacent portions of fishing neck extension 144 and dog expander sleeve 147 that are assembled together with threaded connection 157. Obviously, when the probe structure 133 is lowered to the operation state of FIG. 3, outer cylindrical shank surface 158 below annular shoulder 159 of body member 160 of the projection structure 132 locks the collet arms 151 in the set position state. Then the probe structure 133, along with projection structure 132, must be withdrawn and a fishing tool (not shown) employed to pull the fishing neck extension 144 along with the dog expander sleeves 147 up to the pull state of FIG. 6.

Referring also to FIG. 7, in addition to FIGS. 3, 5, and 6, transitional movement of expander sleeve 147, from the run state of FIG. 5 to the set state of FIG. 3, rides cam surfaces 161 of the sleeve 147 under can surfaces 162 of the dogs 146, thereby moving the dog projections 163 of the two dogs, outwardly, into the mandrel locking state of FIG. 3. When in the dog 146 mandrel state of FIG. 3, dog projection section under surfaces 164 rest on surface 165 of a sleeve 147 that is provided with slots 166 to accommodate body extensions 167 and relative movement therebetween in locking and unlocking movement of the dogs 146. An internal latch structure 168, in the interior of dog retainer housing 150 extension of the mandrel assembly 135 holds latch ends 169 of the dogs 146, limiting relative longitudinal movement therebetween throughout all conditions of relative longitudinal movement between sleeve 147 and dogs 146. The interior of each dog 146 is formed with a cylindrical surface section 170, extending from beneath the dog projection portion 163, through much of the length of dog body extensions 167, that conforms to cylindrical surface 171 of the mandrel collet extension member 172, in both the run and pull states of FIGS. 5 and 6.

Differential pressure acting across the locking mandrel structure also acts across, from bottom to top, the probe structure 133, tending to lift the probe. However, the probe structure 133 is equipped with locking lugs 173, two of which are retained within lug housing 142, with retainer short side edge projections underlying lateral edges of housing openings 174. Locking lugs 173 project outwardly in the operational state of FIG. 3, into the interior of fishing neck extension 144, in locking alignment with fishing neck upper internal shoulder 175, that is sloped at a matching 45° angle with upper beveled surfaces 176 of the lugs 173. These 45° angled surfaces result, with differential pressure lifing of the probe structure 133, in an inward lug 173 force component such that the lower beveled lug corners 177 resist cam riding over bevel-edged annular shoulder 178 of probe member 111', to resist upward withdrawal of the probe member 111' from lug housing 142. While the probe members are securely locked in place against any bottom to top differential pressure existing thereacross, the probe communicates fluid pressure from the bore passages of the device up to the transducer in such a way that the pressure is balanced across the little projection 136. Fluid pressure enters bore 179 of probe bottom nose member 180, that is a free-sliding fit in bore 181 of mandrel collet extension member 172 and connected by thread connection 182 with projection structure 132. The projection structure 132 is equipped with O-rings 183 and 184, that are sliding seal fits in bore 181, and has a three-section 185, 186, and 187, bore interconnecting the bore 179 of bottom nose member 180 with side orifice ports 99'.

The lug 173 lock system of the probe is designed so that when retrieving the probe structure 133 from the well, the upper portion of the probe can be lifted through the equalized state of FIG. 8, to the run state of FIG. 9. This is with the range of relative movement between the upper portion of probe structure 133, and the bottom portion including the lug housing 142 and projection 136, being a movement range permitted by the slot 188 in member 111' and limit pin 189 mounted in lug housing 142 to project into slot 188. It should be noted however that the upper portion of the probe structure cannot be immediately moved relative to the probe lower portion from the operational state of FIG. 3 to the run, unlocked state of FIG. 9 if a significant pressure tending to lift the probe structure exists thereacross. If such a pressure differential does exist, the probe upper portion must be first moved to the intermediate equalizing state of FIG. 8, where O-ring 101' is lowered to clear the larger diameter bore of opening 104. This permits equalizing fluid pressure flow to occur from orifice port 99' to side wall openings 190 in lug housing 142, and through fishing neck extension openings 191, up around the probe structure 133, equalizing fluid pressure in the well above packing seal 93' to, substantially, the well pressure below the seal. Pressure on locking lugs 173 is thereby relaxed, and the lugs 173 may then be cammed over the annular projection 178, with upward movement of member 111' in the transition from the equalizing state of FIG. 8 to the lug 173 and probe unlocked run state of FIG. 9, with lugs 173 fully retracted. It should be noted that the beveled lug surfaces 177 are sloped at a relatively shallow 30° angle to facilitate lug 173 camming movement over the annular projection 178. Further, the lug 173 outer beveled surfaces 192 are also sloped at a 30° angle to facilitate inward lug 173 displacement, should lugs 173 engage fishing neck entrance beveled edge 193 with the probe structure 133 in the run state of FIG. 9, as it is being lowered into position for entering the mandrel assembly 135. Wall opening 117' from the top of opening 104' to the outside of probe member 111' provides for fluid flow to and from the upper portion of opening 104, and avoids hydraulicking problems during telescoping movement of probe member 111' and projection 136. In order for pressure equalizing to occur in the intermediate equalizing state of FIG. 8, the well must be sealed at the top with the cable 38 suspending wire line equipment in the well, moveable through a seal packing gland or stuffing box at the well head, and the well must be completely shut in.

FIG. 11 shows a probe 133' and mandrel assembly 135 combination substantially the same as the probe 133 and mandrel assembly 135 combination of FIGS. 3 through 10, except that a stop plug 194, having an upper fishing neck 195, is connected with threading 113' to probe member 111'. A running tool (not shown) engaged with fishing neck 195 of stop plug 194 can run the probe member 111' in the well to engagement with a previously nipple position set mandrel assembly 135. Operation of the probe 133' and mandrel assembly 135 is otherwise substantially the same as as with the pressure probe embodiment of FIGS. 3 through 10 with, however, stop plug 194 being used the well being stopped from productive flow when a pressure transducer or other equipment being used with the probe and mandrel combination. The locking features of the probe in the mandrel are the same again with the combination of FIG. 11 as with the embodiment of FIGS. 3 through 10.

With the probe modification of FIG. 12 a pipe tubing 196 connection adapter assembly 197 has a bottom member 198 connected by threading 113''' to probe member 111'. The connection adapter assembly 197 also includes an inner tubular support member 199, a slip member 200, an O-ring 201, and a wedge nut member 202 for locking the pipe tubing bottom end in place for flow communication through opening 203 in bottom member 198 from the chamber 110'' to the pipe tubing 196. Pipe tubing 196 can extend to the wellhead for production therethrough or for the feeding of chemicals down therethrough to a desired location in producing formation.

The pipe tubing 196' of FIG. 13 is brazed (or soldered) 204 in the upper tubular end of a fitting member 198' that in turn is connected to a probe member 111' just as is the bottom member 198 in FIG. 12. Pipe tubing 196' is provided with an opening 204 just above fitting member 198' to facilitate the flow of treating fluid down the annulus between pipe tubing 196' and well casing through the opening 205 and then up the pipe tubing 196' along with any production flow through the probe and mandrel structure therebeneath. Reverse flow of treating fluids down through pipe tubing 196' out through opening 205 and up through the annulus between pipe tubing 196' and well tube casing may also be employed.

A concentric gas lift valve 206, of conventional construction, shown on line pipe tubing 196'' may actually be added up the tube to pipe tubing 196 of FIG. 12, or to pipe tubing 196' of FIG. 13 in appropriate well installations where gas lift can be used to advantage in aiding well production flow.

It is of interest to note that the double lock feature of the pressure probe in a mandrel seated in a landing nipple down the well is useful for any number of various structural implementations in holding down the well equipment locked in place.

Whereas this invention is herein illustrated and described with respect to several particular embodiments thereof, it should be realized that various changes may be made without departing from the essential contributions to the art made by the teachings hereof.

We claim:

1. A well hole fluid pressure communicating probe structure for measuring well pressure below a well packer seal located between a mandrel and the well casing bore including, lower structure means with downward travel limit means; probe means connectable to a chamber adapted for containing a fluid pressure sensing device; fluid passage means in said lower structure means in fluid communication with well space below the well packer; fluid passage means in said probe means connectable to said chamber; cooperative telescoping projection means and opening means included with said lower structure means and said probe means having fluid passage openings positionable for establishing fluid communication between said fluid passage means in said lower structure means and said fluid passage means in said probe means; spaced upper seal structure means and lower seal structure means positioned in said cooperative telescoping projection means and opening means structure to be, respectively, above and below said fluid passage openings when they are positioned for establishing fluid communication between said fluid passage means in said lower structure means and said fluid passage means in said probe means; and wherein said cooperative telescoping projection means and opening means are, respectively, with the projection means a part of said lower structure means, and with said opening means in said probe means.

2. A well hold fluid pressure communicating probe structure of claim 1, wherein said lower structure means is in the form of a housing containing said telescoping projection means; and with said probe means movable down into said housing when said cooperative telescoping projection means and opening means are brought into telescoping relation.

3. The well hole fluid pressure communicating probe structure of claim 1, wherein with said lower structure means in place in a well and said probe means drawn up out of the way, the well packer seal and mandrel lower structure means seal the well to limit well flow to flow through said fluid passage means and said fluid passage opening in said lower structure means.

4. The well hole fluid pressure communicating probe structure of claim 1, wherein plunger means is slidably contained in said opening means; and in an extension of said opening means; and with said plunger means slidable upwardly into said extension of said opening means as said probe assembly is telescoped on said cooperative telescoping projection.

5. The well hole fluid pressure communicating probe structure of claim 4, wherein said upper and said lower seal structure means are retained in seal grooves in cylindrical wall means of said opening means of the probe assembly.

6. The well hole fluid pressure communicating probe structure of claim 5, wherein resilient means contained within said extension of said opening means biases said plunger means toward a lower position in said opening means where the plunger mean overlies said upper and lower seal structure means.

7. The well hole fluid pressure communicating probe structure of claim 6, wherein through wall passage means is provided from said extension of said opening means to the exterior of said probe means.

8. The well hole fluid pressure communicating prove structure of claim 1, wherein said lower structure means includes an elongate structure slidably mounted in the mandrel for limited upward and downward movement relative to the mandrel, and with said telescoping projection means at the top of said elongate structure; a mandrel bottom end nose housing member having a spring chamber containing a resiliently compressible spring urging said elongate structure toward an upper position, and with said nose housing member having continually open spring chamber to below the packer seal fluid communication opening means; said elongate structure being formed with a lower cylindrical valve body end slidably received in said spring chamber, a shank section of lesser diameter slidably contained in a bore of said mandrel and displaceable with downward movement of said elongate structure from the bore of said mandrel, and a smaller diameter upwardly extended stem section terminating at the top in a projection member and forming an annulus space with an extended bore in said mandrel, side wall valve port means normally closed with the lower cylindrical valve body in its upper limit position and open to fluid flow from the well below said packer seal when the lower cylindrical valve body is lowered; and with said valve port means open in fluid communication with said annulus space when said shank section is lowered from its cooperating bore of the mandrel.

9. The well hole fluid pressure communicating probe structure of claim 8, wherein an open channeled member mounted in said mandrel provides bearing support for up and down relative sliding movement of said projection member and said elongate structure; and the open channeled member provides fluid communication from said annulus space to space in the mandrel above said channeled member.

10. The well hole fluid pressure communicating probe structure of claim 9, wherein there is annular space between said probe means and inward opening means of the mandrel structure for upward fluid flow communication from said channeled member to well space above said well packer seal.

11. The well hole fluid pressure communicating probe structure of claim 8, wherein seal means is included on said shank section that is slidable from said bore of the mandrel with downward sliding movement of said shank section and the elongate structure.

12. The well hole fluid pressure communicating probe structure of claim 1, wherein said lower structure means and said probe means are interconnected by limited relative longitudinal movement limit means limiting relative movement therebetween, between two limit position states.

13. The well fluid pressure communicating probe structure of claim 12, wherein said limited relative longitudinal movement limit means are cooperative pin and slot movement limit means.

14. The well hole fluid pressure communicating probe structure of claim 12, wherein said cooperative telescoping projection means and opening means are at least partially telescoped in an outermost run state limit position.

15. The well hole fluid pressure communicating probe structure of claim 14, wherein an extension of said opening means contains resiliently compressible spring means biasing the cooperative telescoping projection means and opening means to the outermost run state limit position.

16. The well hole fluid pressure communicating probe structure of claim 12, wherein said lower structure means has an annular shoulder that is dimensioned for landed seating engagement with landing shoulder means of said mandrel; and with said landing shoulder means of said mandrel suporting said lower structure means as said probe means is lowered further from a run state limit position to an opposite set limit position state, with said cooperative telescoping projection means and opening means of said probe means fully telescoped.

17. The well hole fluid pressure communicating probe structure of claim 16, wherein said lower structure means has an upper housing extension with said telescoping projection means extended upwardly therewithin, and having bore means receiving the lower end of said probe means with the opening means telescoping down on said telescoping projection.

18. The well hole fluid pressure communicating probe structure of claim 17, wherein said upper housing extension is a locking lug housing; locking lug means held for cam driven inward and outward movement; locking lug cam drive outer surface means on the outer surface of said probe means cam driving said locking lug means from a radial innermost non-locking state to a radially extended outwardly projecting locking state alignment with locking lug shoulder means of said mandrel with lug camming movement of the probe means from the run state to the set state.

19. The well hole fluid pressure communicating probe structure of claim 18, wherein the locking lug shoulder is internal shoulder means of an upper fising neck extension of the mandrel structure formed with an annular bore section terminated at the top by said internal shoulder means.

20. The well hole fluid pressure communicating probe structure of claim 19, wherein said locking member is a down-the-well pressure measuring probe structure.

21. The well hole fluid pressure communicating probe structure of claim 20, wherein the locking lug cam drive outer surface means is formed with an annular raised shoulder locking the lower end of said probe means in an equalizing state relative position with differential lifting force pressure developing an inward force component on said locking lug means, in an intermediate equalizing state until fluid differential pressure across the device bottom to top approaches equalization, resisting camming of said locking lug means over said annular raised shoulder in relative movement toward said run state.

22. The well hole fluid pressure communicating probe structure of claim 21, wherein a collet extension is included in the mandrel structure with a plurality of mandrel collet extension fingers extended upwardly and equipped with radially outwardly extended lock projections equipped with upper and lower sloped cam surfaces for cam riding into annular recesses and over intervening raised internal bosses of a relatively movable cam locking sleeve and fishing neck structure; and with positioning of said lower structure of the probe device in landed state being a lock body preventing cammed inward withdrawal of the collet extension fingers from insertion in an annular recess of said cam locking sleeve and fishing neck structure.

23. The well hole fluid pressure communicating probe structure of claim 22, wherein said relatively movable cam locking sleeve and fishing neck structure is movable from a run state position with said collet arm projections resting in a first annular recess of the cam locking sleeve and fishing neck structure; with said cam locking sleeve being part of a locking mandrel locking dog cam actuating structure locking and unlocking the locking mandrel in camming locking dog means into and out of a locking recess in a casing landing nipple with movement of the cam locking sleeve and fishing neck structure from a run state position with the collet finger projections in said first annular recess to a set state with the collet arm projections resting in a second annular recess of the cam locking sleeve and fishing neck structure.

24. The well hole fluid pressure communicating probe structure of claim 23, wherein, when the probe structure with said lower structure means is withdrawn from within the mandrel structure and from set state locking position, backing said collet fingers, with the finger projections in the set state resting in said second recess, the cam locking sleeve and fishing neck structure may be drawn from the set state through the run state to a pull state with the collet finger projections resting on an internal bore of said cam locking sleeve, and with the collet fingers deflected radially inwardly and collectively defining a restricted bore at the inwardly deflected finger ends.

25. A well locking mandrel equipped with landing key means for being landed in a well casing landing nipple, and when in place in a well, having a well packer seal located between the mandrel and the well casing bore including, spring-loaded landing keys adapted for landing in mating recesses of a casing landing nipple; locking dog means held in dog housing means of said locking mandrel for movement radially outward and inward into and out of locking projection into an annular dog receiving lock recess provided in the casing landing nipple; camming drive means for camming said locking dog means radially outwardly into a dog receiving lock recess in the casing landing nipple; said camming drive means including sleeve means movable in the structure of the mandrel assembly from a non-lock position to a dog-cammed locked position; a fishing neck extension included with said sleeve means, with said sleeve means and fishing neck extension mounted for being longitudinally movable through a range of movement in the well locking mandrel structure; a mandrel collet extension included in the mandrel structure with a plurality of mandrel collet extension fingers extending upwardly within said sleeve means; said collet extension fingers being equipped with radially outwardly extended lock projections equipped with upper and lower cam surfaces; annular shoulder means with cam sloped edges in said sleeve means and fishing neck extension structure cooperatively engageable by said collet extension finger projections and with finger projections being resiliently deflectable inwardly and outwardly in cam riding over said annular shoulder means into and out of annular recess means provided in said sleeve means and fishing neck extension; and with said collet extension fingers defining, collectively, an internal bore of a first size with the finger projections in annular recess means of said sleeve means and said fishing neck extension and an internal bore of smaller size when said finger projections are riding on said annular shoulder means; and with said collet extension fingers in a locked state retention in annular recess means of said sleeve means and said fishing neck extension when a locking member, having a diameter less than the internal bore of said first size and greater than the internal bore of smaller size defined by the collective interiors of said collet extension fingers, is positioned within the bore of said fingers.

26. The well locking mandrel of claim 25, wherein said fishing neck extension is formed with an annular bore section terminated at the top by internal shoulder means with a cam-sloped lower shoulder edge; lug lock means mounted in said locking member for radially inward and outward movement to locking interference alignment with the internal shoulder means of said fishing neck extension; and with lug lock means outward movement drive means in said locking member.

27. The well locking mandrel of claim 26, wherein said locking member is a down-the-well pressure measuring probe structure.

28. The well locking mandrel of claim 27, wherein said well pressure measuring probe structure is a wireline tool suspended and positioned by wireline from the surface.

29. The well locking mandrel of claim 25, wherein said annular recess means includes a lower annular recess with upper and lower cam sloped edges; and with the lower annular recess sized to receive said finger projections with said locking mandrel in a run state prior to said fishing neck extension and said sleeve being moved from the non-lock position to the dog cammed locked position.

30. The well locking mandrel of claim 29, wherein said annular recess means also includes an upper annular recess in said fishing neck extension with a lower cam sloped edge over which said finger projections ride when said fishing neck extension and said sleeve are moved to the dog cammed locked position; and with said finger projections positioned in said upper annular recess, positioning of said locking member within the bore of said fingers, being an interference locking fit blocking cammed inward unlocking movement of the finger projections from said upper annular recess in the fishing neck extension.

31. The well locking mandrel of claim 30, wherein said fishing neck extension is formed with an annular bore section terminated at the top by internal shoulder means with cam sloped upper and lower shoulder edges; lug lock means mounted in said locking member for radially inward and outward movement to locking interference alignment with the internal shoulder means of said fishing neck extension; and with lug lock means outward movement drive means in said locking member.

32. The well locking mandrel of claim 31, wherein said lug lock means includes a plurality of locking lugs having cam beveled upper and lower outer surfaces adapted for cam riding over said cam slopped upper and lower shoulder edges of the internal shoulder means at the top of said annular bore section.

33. The well locking mandrel of claim 32, wherein cam lug drive means is mounted within said locking member for cam driving said plurality of locking lugs into locking interference alignment with the internal shoulder means of said fishing neck extension.

34. The well locking mandrel of claim 33, wherein, with said locking lugs in locking position within said annular bore section of the fishing neck extension, said locking member being in locking position holding the collet fingers in a locked state with said finger projections positioned in said upper annular recess in the fishing neck extension.

35. The well locking mandrel of claim 33, wherein said locking lugs are formed with beveled upper cam surfaces of one slope and lower cam surfaces of shallower slope.

36. The well locking mandrel of claim 35, wherein said locking lugs are also formed with cam beveled upper and lower inner surfaces.

37. A well hole fluid pressure communicating probe structure for measuring well pressure below a well packer seal located between a mandrel and the well casing bore including, a housing in said mandrel; a probe assembly longitudinally movable within said housing; fluid passage means connected to a chamber within said probe assembly; fluid passage means in said housing in fluid communication with well space below the well packer seal; cooperative telescoping projection and opening means included with said housing and said probe assembly, and having fluid passage openings positionable for establishing fluid communication between said fluid passage means in said housing and said fluid passage means in said probe assembly; and wherein the telescoping projection is part of said housing; and said opening means is an opening in said probe assembly sized to slidingly receive said telescoping projection in telescoping relation.

38. The well hole fluid pressure communicating probe structure of claim 37, wherein spaced upper O-ring seal structure means and lower O-ring seal structure means are positioned in said cooperative telescoping projection and opening means to be, respectively, above and below said fluid passage openings when the openings are positioned for establishing fluid communication between said fluid passage means in said housing and said fluid passage means in said probe assembly.

39. The well hole fluid pressure communicating probe structure of claim 38, wherein said upper and said lower O-ring seal structure means include O-ring retaining seal grooves in wall means of said opening means in said probe assembly.

40. The well hole fluid pressure communicating probe structure of claim 39, wherein plunger means is slidably contained in said opening means; and with said plunger means slidable upwardly as said probe assembly is telescoped on said cooperative telescoping projection.

41. The well hole fluid pressure communicating probe structure of claim 40, wherein fluid passage means are positioned in said plunger means to communicate with said fluid passage means within said probe assembly when the plunger means is in a lower position for pressure relief of said chamber when the cooperative telescoping projection is not telescoped into the opening means of said probe assembly.

42. The well hole fluid pressure communicating probe structure of claim 38, wherein said upper and said lower O-ring seal structure means include O-ring retaining seal grooves in said telescoping projection.

43. A well hole fluid communicating probe structure for well fluid communication from below a well packer seal located between a mandrel and the well casing bore including, a housing in said mandrel; a probe assembly longitudinally movable within said housing; fluid passage means through said probe assembly; fluid passage means in said housing in fluid communication with well space below the well packer seal; cooperative telescoping projection and opening means included with said housing and said probe assembly, and having fluid passage openings positionable for establishing fluid communication between said fluid passage means in said housing and said fluid passage means in said probe assembly; and wherein the telescoping projection is part of said housing; and said opening means is an opening in said probe assembly sized to slidingly receive said telescoping projection in telescoping relation.

44. The well hole fluid communicating probe structure of claim 43, including plug means inserted into said probe structure for blocking fluid flow through the probe structure when blocking the well from fluid flow at a selected down-the-well location is desired.

45. The well hole fluid communicating probe structure of claim 44, wherein said plug means is removably connected to said probe structure by a threaded connection at the top of the probe structure; and said plug means has an upper fishing neck extension.

46. The well hole fluid communicating probe structure of claim 43, including probe structure to pipe tubing interconnect means at the top of the probe structure; and pipe tubing extending up the well hole from said interconnect means.

47. The well hole fluid communicating probe structure of claim 46, with gas lift valve means mounted on said pipe tubing extending up the well hole.

48. The well hole fluid communicating probe structure of claim 46, with well opening means in said pipe tubing extending up the well hole for fluid therethrough.

49. The well hole fluid communicating probe structure of claim 46, wherein said interconnect means at the top of the probe structure includes pipe tube end insertion and brazed interconnect with said interconnect means.

50. The well hole fluid communicating probe structure of claim 46, wherein said interconnect means includes a connection adapter assembly having a bottom member, with a through opening threadingly connected to said probe structure; and pipe tube end enclosing and clamping structure means.

51. In a tubular casing landing and tool structure a locking system for locating and position locking in grooves of the tube casing, or a casing landing nipple in the tube, a mandrel including spring-loaded landing keys adapted for landing in mating recesses of the tube casing; locking dog means held in dog housing means of said locking mandrel for movement radially outward and inward into and out of locking projection into an annular dog receiving lock recess provided in the tube casing; camming drive means for camming said locking dog means radially outwardly into a dog receiving lock recess in the tube casing; said camming drive means including sleeve means movable in the structure of the mandrel assembly from a non-lock position to a dog-cammed locked position; said sleeve means mounted for being longitudinally movable through a range of movement in the locking mandrel structure; a mandrel collet extension included in the mandrel structure with a plurality of mandrel collet extension fingers extending upwardly within said sleeve means; said collet extension fingers being equipped with radially outwardly extended lock projections equipped with upper and lower cam surfaces; annular shoulder means with cam sloped edges in said sleeve means and fishing neck extension structure cooperatively engageable by said collet extension finger projections and with finger projections being resiliently deflectable inwardly and outwardly in cam riding over said annular shoulder means into and out of annular recess means provided in said sleeve means; and with said collet extension fingers defining, collectively, an internal bore of a first size with the finger projections in annular recess means of said sleeve means and an internal bore of smaller size when said finger projections are riding on said annular shoulder means; and with said collet extension fingers in a locked state retention in annular recess means of said sleeve means when a locking member, having a diameter less than the internal bore of said first size and greater than the internal bore of smaller size defined by the collective interiors of said collet extension fingers, is positioned within the bore of said fingers.

52. The tubular casing landing and tool structure locking structure of claim 51, wherein said sleeve means includes extension means formed with an annular bore section terminated at the top by internal shoulder means with a cam-sloped lower shoulder edge; lug lock means mounted in said locking member for radially inward and outward movement to locking interference alignment with the internal shoulder means of said extension means; and with lug lock means outward movement drive means in said locking member.

53. The tubular casing landing and tool structure locking structure of claim 51, wherein said annular recess means includes a lower annular recess with upper and lower cam sloped edges; and with the lower annular recess sized to receive said finger projections with said locking mandrel in a run state prior to said sleeve means being moved from the non-lock position to the dog cammed locked position.

54. The tubular casing landing and tool structure locking structure of claim 53, wherein said annular recess means also includes an upper annular recess in said extension means of said sleeve means with a lower cam sloped edge over which said finger projections ride when said extension means and said sleeve are moved to the dog cammed locked position; and with said finger projections positioned in said upper annular recess, positioning of said locking member within the bore of said fingers, being an interference locking fit blocking cammed inward unlocking movement of the finger projections from said upper annular recess in the extension means.

55. The tubular casing landing and tool structure locking structure of claim 54, wherein said extension means is formed with an annular bore section terminated at the top by internal shoulder means with cam sloped upper and lower shoulder edges; lug lock means mounted in said locking member for radially inward and outward movement to locking interference alignment with the internal shoulder means of said extension means; and with lug lock means outward movement drive means in said locking member.

56. The tubular casing landing and tool structure locking structure of claim 54, wherein said lug lock means includes a plurality of locking lugs having cam beveled upper and lower outer surfaces adapted for cam riding over said cam sloped upper and lower shoulder edges of the internal shoulder means at the top of said annular bore section.

57. The tubular casing landing and tool structure of claim 56, wherein cam lug drive means is mounted within said locking member for cam driving said plurality of locking lugs into locking interference alignment with the internal shoulder means of said extension means.

58. The tubular casing landing and tool structure locking structure of claim 56, wherein, with said locking lugs in locking position within said annular bore section of the extension means, said locking member being in locking position holding the collet fingers in a locked state with said finger projections positioned in said upper annular recess in the extension means.

59. The tubular casing landing and tool structure locking structure of claim 56, wherein said locking lugs are formed with beveled upper cam surfaces of one slope and lower cam surfaces of shallower slope.

60. The tubular casing landing and tool structure locking structure of claim 59, wherein said locking lugs are also formed with cam beveled upper and lower inner surfaces.

* * * * *